United States Patent [19]

Oka et al.

[11] Patent Number: 4,828,953

[45] Date of Patent: May 9, 1989

[54] METHOD FOR THE FORMATION OF OUTLINE IMAGES CORRESPONDING TO THE PERIPHERAL OUTLINES OF DOCUMENT'S IMAGES

[75] Inventors: Tateki Oka; Naoki Toyoshi; Tomoaki Yokoyama, all of Toyokawa, Japan

[73] Assignee: Minolta Camera Kabushiki Kaisha, Osaka, Japan

[21] Appl. No.: 58,266

[22] Filed: May 21, 1987

[30] Foreign Application Priority Data

Jun. 10, 1986 [JP] Japan ..... 61-135409
Jun. 10, 1986 [JP] Japan ..... 61-135410

[51] Int. Cl.[4] ..... G03G 13/052; G03G 13/06

[52] U.S. Cl. ..... 430/100; 430/122; 430/53; 355/218; 355/245

[58] Field of Search ..... 430/100, 122, 97, 53; 355/3 CH

[56] References Cited

U.S. PATENT DOCUMENTS 3,967,891 7/1976 Rippstein ..... 355/3
4,286,036 8/1981 Hendriksma .
4,634,259 1/1987 Oishi et al. .

FOREIGN PATENT DOCUMENTS 51-134635 11/1976 Japan .
54-30833 3/1979 Japan .

*Primary Examiner*—J. David Welsh
*Attorney, Agent, or Firm*—Wenderoth, Lind & Ponack

[57] ABSTRACT

The present invention relates to a method for forming an outline of an image. By this method, at first, an electrostatic latent image bearing member is charged and then irradiated to a negative image to form an electrostatic latent image. Thereafter, the irradiated member is re-charged with a scorotron charger while applying a voltage to a grid, said voltage being lower than the surface potential of the non-image portion of the latent image, being higher than the potential of the image portion of the latent image and being of the same porality as that of the charging. By this re-charging, in one embodiment, the outline portion of the image has lower potential than the other portion. Then, the outline portion of the image with lower potential is visualized with a reversal development by using a toner charged to a polarity same as the polarity of charging.

Or in another embodiment, the outline portion of the image has higher potential than the other portion. Then, the outline portion of the image with high potential is visualized with a normal development by using a toner charged to a polarity opposite to the polarity of charging.

18 Claims, 8 Drawing Sheets

METHOD FOR THE FORMATION OF OUTLINE IMAGES CORRESPONDING TO THE PERIPHERAL OUTLINES OF DOCUMENT'S IMAGES

BACKGROUND OF THE INVENTION

1. Field of the Invention:

This invention relates to the outline image forming method which constitutes one of image forming processes relying upon the electrophotographic copying technology. More specifically, it relates to a method for the formation of outline images corresponding to peripheral outlines of negative document's images or negative images formed by laser, LED and the like.

2. Description of the Prior Art:

Generally speaking, the peripheral outline of an image is in practice full of necessary information thereabout and represents enough sufficiently the characterizing features of the given image, thus playing among others a most important role in the judgement of the latter.

The outline image so-called means such that a peripheral outline is picked up from an image and devoid of intermediate tones of reversely, solid representations, thus being most effective for the identification of the practical image and for pattern recognization purpose thereof.

As an example, such a complex color image pattern may be attractive to realize by execution of twice successive copying operations a blank pattern encircled by a color outline, or to prepare a blank pattern for later producing differently colored local image areas contained therein.

It should be noted that in the name of the present assignee company per se, it has already been proposed to realize an outline image-forming process, wherein, in case of the mono-component type toner developing method using conductive toner to develop static latent images, said process being characterized by that, between the material to be subjected to developing and the carrier for the conductive toner, a d.c.-bias voltage is impressed at a medium potential ranged between maximum and minimum surface potential of said material and having an opposite polarity to the static latent image charge, for extracting the outline marginal configuration only from the latent image on said material to be developed (refer to Japanese Open Patent Specification, unexamined, Sho-51-134635).

It should be further noted, however, that there is a considerable drawback in the above-mentioned prior art improvement. In this proposed process, indeed, the developed marginal outline image is only of negative one, because of such fact that the marginal outline of the static latent image is also negative and the conductive toner will be deposited onto substantial part of the latent image devoid of the marginal outline thereof, and indeed, by virtue of higher potential difference charged at the substantive part of the latent image on the drum. In practice, however, the wanted marginal outline should preferably be in black and thus positive. Therefore, the thus formed negative outline image must generally be subjected to a further reproducing step relying upon the reverse development principle, which represents naturally a grave and troublesome drawback inherent in the above improving known process.

SUMMARY OF THE INVENTION

It is, therefore, a main object of the present invention to provide a still further improved method for producing a sharp and clear, blurless outline image.

Another object is to provide a unique outline image forming method in accordance with which, the toner is deposited on along inside of the peripheral outline of the latent image corresponding to the negative documents image, relying upon the reversal developing technique, so as to make the outline image visual, and thus to produce a high quality outline image.

Still another object is to provide a unique outline image forming method in accordance with which, the toner is deposited on along outside of the peripheral outline of the latent image corresponding to the negative documents image, relying upon the normal development, so as to make the outline image visual, and thus to produce a high quality outline image.

For fulfilment of these and further objects, a preferred mode of the present invention comprises:

- a first charging step for applying electric charge of a predetermined potential level onto the surface of a static latent image carriable member, preferably a photo-sensitive drum;
- an exposure step for exposure of negative image or images onto the surface of said static latent image carriable member upon execution of said first charging step;
- a second charging step for recharging the surface of said member upon execution of said exposure step and by applying an electric voltage at a lower potential level than that prevailing at the non-image area of the static latent image or images formed in the foregoing exposure step and at a higher ppotential level than that prevailing at the image areas of said static latent image or images, and having same polarity with the charge adopted in said first charging step, through grid means by a scorotron charger; and
- a developing step for reversingly or normally developing the static latent image formed in said second charging step, with use of charged toner of the same or opposite polarity to that as adopted in said first charging step.

BRIEF DESCRIPTION OF THE DRAWINGS

In the following description, like parts are designated by like reference numerals throughout the several drawings.

PREFERRED EMBODIMENTS

In the following, a preferred first embodiment of the inventive outline image-forming method will be set forth with reference to the drawings.

Figure 1:
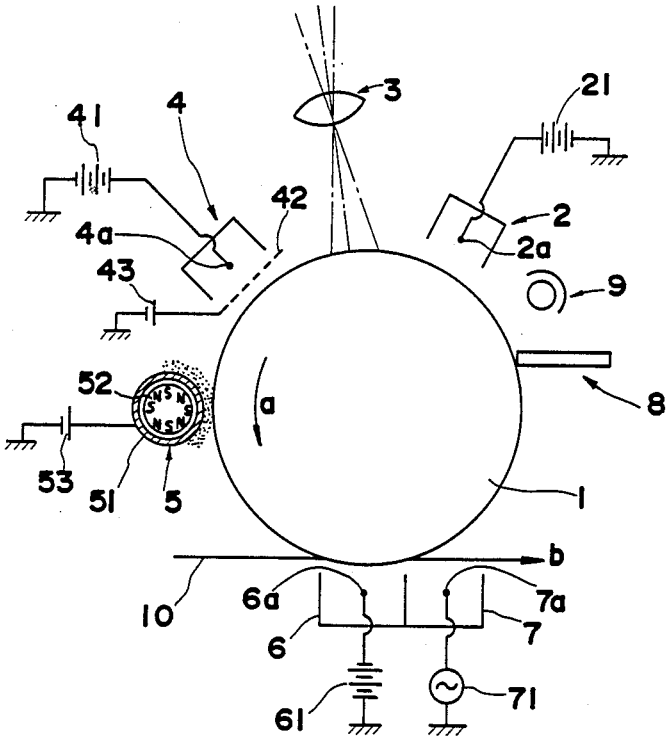
FIG. 1 is a schematic elevation of a first preferred embodiment of electrostatic photocopier adapted for execution of the inventive method for forming peripheral outline images in unique manner.

FIG. 1 illustrates only schematically an electrophotographic copier adapted for carrying out the process according to the invention.

Numeral 1 shows a photosensitive drum, having a photosensitive layer on the cylindrical surface, as is conventional. The rotational direction is shown by a small arrow (a). Several units and apparatuses are provided, as will be more specifically set forth hereinbelow.

Numeral 2 represents a static charger such as a corona charger, having a charging wire 2*a* electrically connected to a power source 21, the negative pole thereof being earthed as shown. This charger 2 is adapted for execution of the first charging job, so as to charge the drum surface layer to a certain predetermined static potential level.

Numeral 3 represents only schematically an image exposing apparatus adapted for forming static latent images, corresponding to original or negative document images, onto the drum surface under utilization of conventional slit exposure system, and comprises exposure lamp, mirror, lens and the like constituents. In FIG. 1, the image exposing apparatus 3 is shown only schematically and representatively by a projecting condenser lens.

As this image exposing apparatus 3, any methods can be adopted wherein a negative electorstatic latent image can be formed. For example, exposure system of scanning type based on an electrical signal such as laser, LED and the like may be adopted.

Numeral 4 represents a second or "scorotron"-charger, which is adapted for execution of a second charging job onto the surface of drum 1 after the formation of latent images thereon, as was set forth hereinbefore. The second charger 4 is provided with a charge wire 4*a* connected to a power source 41, the negative pole thereof being earthed as shown. A grid 42 of the second charger 4 is provided which is connected with a separate power source 43, the negative pole thereof being earthed as shown. Charge wire 4*a* is impressed from the power source 41 with such a voltage as of same polarity with that prevailing at the charger 2. Grid 42 is impressed from power source 43 with a somewhat lower voltage than the surface potential prevailing at non-image area on the drum 1, said voltage having same polarity with that prevailing at the charger 2. It should be noted further that the voltage impressed at the grid 42 must be rather higher than the surface potential prevailing at the image area of the latent image on the drum.

Numeral 5 represents generally a developing device comprising a developing sleeve ring 51 or cylinder and a magnet roller 52 fixedly mounted in said ring or cylinder and having a number of alternating N- and S- poles at its periphery. The said developer is capable of operating in the known magnetic brushing principle. The developing sleeve ring 51 can also operate as developing electrode means, a developing and biasing voltage source 53 being electrically connected to said sleeve. As the developing agent, preferably a mixture of magnetic carrier and insulative toner is used representatively as connectional. These mixture constituents are charged with mutually opposite polarities through a frictionally charging step. Further, the insulative toner is charged to have a same polarity to that of charger 2 by the said friction charging step.

If the used insulation toner is non-magnetic, developing sleeve 51 is impressed from voltage source 53 with a developing bias somewhat lower than the grid voltage and being of the same polarity with charger 2.

If desired, however, the insulative toner may be magnetic. In this case, developing sleeve 51 may be impressed with a bias voltage at somewhat higher level than the surface potential prevailing at the image area(s) of the static latent image per se, which surface potential has been elevated in the second charging step.

As an alternative measure, such a developing bias which has been superposed with a a.c.-voltage can be applied to the developing sleeve. In the case of magnetic toner, insulative toner only may be used.

Numeral 6 represents a transfer charger, which is so designed and arranged as to impress onto a copy paper 10 being conveyed as shown by a small arrow (b) an electrical field from the rear side of the paper, as to transfer the toner image(s) on the surface of sensitive drum 1 under the action of developing unit 5. For this purpose, charger 6 is fitted with a charge wire 6*a* which is connected with a power source 61, the positive pole of the latter being earthed as shown. In this way, the charge wire 6*a* is impressed with a voltage to reversed polarity to that owned by the insulative toner.

Numeral 7 represents a separation charger, which is adapted for impressing an alternating electrical field to the copy paper directly upon execution of said transfer step, for the purpose of removing residual charge therefrom, so as to separate the paper from the surface of drum 1. For this purpose, charge wire 7*a* of the charger 7 is fed with an alternating voltage from a current source 71.

Numeral 8 represents a cleaner unit adapted for removing residual toner from the drum surface in the blade system so called among those skilled in the art.

Numeral 9 represents an eraser lamp adapted for removal of residual charges from the drum surface through the way of opto-projection and for making the drum surface ready for execution of the next succeeding photo-copying job.

In the following, only by way of example, polarities and impressing or impressed voltages with relation to several chargers and the like, as used in the present embodiment, will be set forth.

(I). In use of non-magnetic insulative toner:

charger (voltage source 21)
  positive, +5.5 kV
scoroton charger (voltage source 41)
  positive, +5.5 kV
grid (voltage source 43)
  positive, +500 V
distance between grid and drum (dg)
  1.5 mm
developing bias (voltage source 53)

positive, +400 V
transfer charger (voltage source 61)
negative, −6.0 kV
insulative toner
positive
(II). In use of insulative and magnetic toner:
static charger (voltage source 21)
positive, +5.5 kV
scorotron charger (voltage source 41)
positive, +5.5 kV
grid (voltage source 43)
positive, +500 V
distance between grid and drum (dg)
1.5 mm
developing bias (voltage source 53)
positive (d.c.), +530 V
a.c., 350 V rms, 1 kHz,
starting potential for development
+450 V
insulative- and magnetic toner
positive It should be noted that above mentioned polarities may be all reversed. Voltage values enlisted above are naturally given only by way of example and thus may be varied according to occasional demands.

The method for the formation of marginal outline image with use of the foregoing copier machine will be set forth stepwise hereinbelow.

(i). First charging step:

A charge at a predetermined potential level is applied evenly on the sensitive drum 1 by charger 2. As a result, the surface potential of drum 1 will amount to +600 V.

Figure 3:
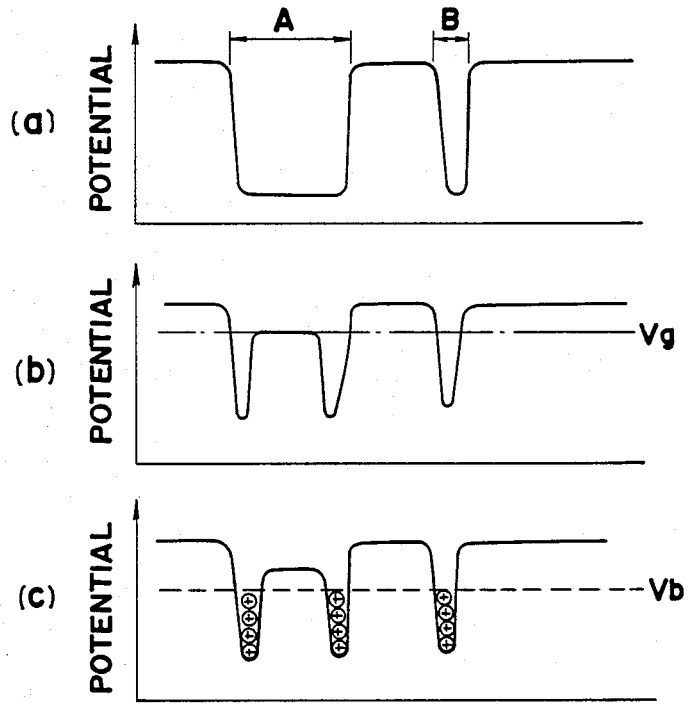
FIGS. 3, (*a*), (*b*) and (*c*) are such charts showing electrical potentials as appearing in several steps in the method according to the invention.

(ii). Exposure step:

Original negative document images are exposed onto the drum surface charged with +600 V in the foregoing step. The exposure may be carried into effect by the slit exposure means as conventionally, so as to form the corresponding static latent images thereon. In this case, as shown in FIG. 3 at (a), the charge remaining at image areas (A) and (B) is reduced to +100 V or so, while the charge existing at non-image areas devoid of the imaged one amounts to +600 V-potential. Naturally, the document images were negative.

(iii). Second charging step:

A charge of same polarity with the negative static latent images is applied by the scorotron charger 4 onto the drum surface, on which the negative latent images have been provided to form in the foregoing step. In case that non-magnetic insulative toner or magnetic insulative toner is used, grid 42 is impressed with a voltage of +500 V. The charge at scorotron charger 4 is of the same polarity to that adopted in the first charging step, while the voltage as applied to the grid 42 is somewhat lower than that prevailing at the non-image areas, +600 V, and of the same polarity as was adopted in the first charging step. Additionally, the voltage impressed upon grid 42 is higher than the surface potential, +100 V, at the image areas on the drum.

Figure 2:
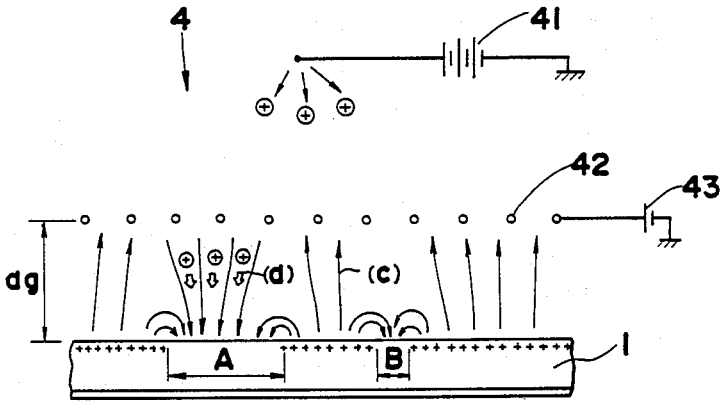
FIG. 2 is a schema of electric line of force as appearing in the first embodiment at the second charging step.

As a result, lines of electrical force as shown by arrows (c) in FIG. 2 between the drum surface and the grid are created, and positive ions issuing from the related charge wire will receive conveying forces along the lines of force set forth just above. In this case, the lines of force accelerating the positive ions, in proximity of the grid 42 towards the drum surface at 1, are only effective in the central imaged portions devoid of peripheral outlines per se of the image areas (A) and (B). Therefore, the positive ions can arrive exclusively at the central portions defined by and devoid of marginal outlines of the imaged areas (A); (B), as shown by double lined small arrows (d). Thus, the positive ions will arrive only at the rather central portion of surface image areas (A), devoid of inside marginal zone thereof, to elevate considerably to such value as substantially same level as the grid potential, +500 V.

When illustrating more specifically in terms of drum surface potentials, the potential at inside band zone along the peripheral outline of a broad areal imaged portion (A) and that residing at an elongated band zone along strip-like image portion (B), as an example, each having a substantially constant width, remains at a lower potential level of substantially +100 V as shown in FIG. 3 (*b*), while the statically charged non-image area hold their initial surface potential without alteration, amounting substantially to a higher potential level which is substantially +600 V. And rather central portion of the areal image portion (A) will elevate in its value to such a level substantially equal to the grid voltage (Vg: +500 V). On the other hand, the surface potential (Vo) at the strip like image portion will generally be subjected to substantially no alteration, but the width of the charged band zone will somewhat be reduced.

In other words, as a result of this second charging step, marginal outlines of these imaged zones (A) and (B) will be formed in form of static negative latent images.

(iv). Developing step:

In the present second charging step, the thus formed negative outline images are further subjected to the presently employed developing step under the action of developing unit 5. When the insulative toner is non-magnetic, the developing sleeve 51 is impressed with a developing bias of +400 V, as an example. This developing bias voltage, Vb, is selected to be somewhat lower than the grid voltage, Vg, +500 V, as an example, and lower than the substantively imaged area potential at (A) which has been caused to elevate to such a value as substantially equal to the grid voltage, Vg, and having the same polarity as was employed in the first charging step, and indeed, for the purpose of preventing superfluous and fouling toner-deposition, not only at non-image areas, but also at imaged areas, surface potentials in the image areas having been caused to elevate considerably in the second charging step, as was referred to hereinabove.

On the contrary, when the insulative toner is magnetic, the developing sleeve 51 is impressed with a.c. −350 V, 1 kHz, plus d.c.-plus 530 V, as an developing bias.

This developing bias voltage, Vb, is selected to be somewhat higher than the grid voltage, Vg: 500 V, thus being higher than the potential level at the substantive part of the image area, the latter potential having been elevated precisely or nearly to the grid voltage, Vg. With use of magnetic toner, however, a certain threshold value may exist on account of the very existence of magnetically binding action, the drvelopment will normally start at +450 V or so of the surface potential.

Under this operating condition, there is no fear of superfluous and fouling deposition of the toner on the substantive part of the statically formed latent image areas as well as the non-image areas, wherein in the former potential levels thereat have been caused in the second charging step considerably to elevate.

Under these operating conditions, and as shown in FIG. 3 at (c), the positively charged insulative toner particles will be deposited onto the lower potential regeions on the drum surface, or more specifically, exclusively onto the marginal outline portions insidely around the imaged areas (A) and (B), thereby a kind of tonered "embroidering" inside edge lines being formed upon execution of a reversed development job. Then, these toner images are transferred onto the copy paper 10 upon execution of negative discharge at transfer charger 6 and then subjected to a fixing job at a conventional fixing unit, not shown, to provide corresponding photo-copied images.

(III). A slightly modified example from that set forth hereinbefore, and with use of non-magnetic insulative toner which has been used equally in the first embodiment, in such a sense that the operating conditions of the scorotron charger 4 have been changed, will be described. In this case, the following operating items have been modified from those as set forth at the foregoing (I), although non-magnetic insulative toner has been employed in the foregoing.

Scorotron charger (voltage source 41)
  positive, +6.5 kV
grid (voltage source 43)
  positive, +400 V
distance between grid and drum (dg)
  1.0 mm
developing bias (voltage source 53)
  positive, +430 V In this modification, the charging performance of the scorotron charger 4 is higher than before, the potential at the central portion of the image area will rise to +450 V or so which is somewhat higher than grid voltage, Vg, with exception of inner peripheral range around imaged areas (A) and (B). In addition, the developing bias potential, Vb, has been specified to +430 V which is naturally higher than grid potential Vg, +400 V, but it is lower than the above elevated surface potential +450 V. Therefore, disadvantageous and fouling toner deposition at the central portion of the image areas can be positively prevented.

Figure 4:
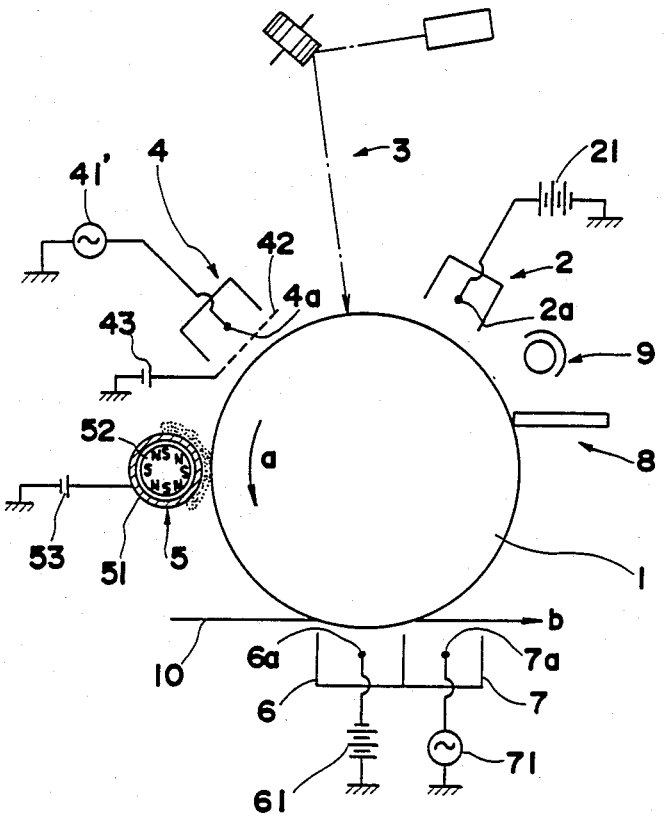
FIG. 4 is a similar view to FIG. 1, showing, however, the case of a second embodiment.
Figure 5:
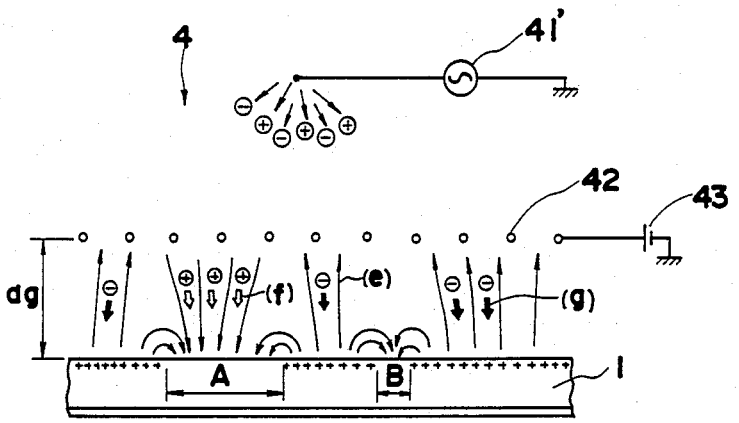
FIG. 5 is a similar view to FIG. 2, showing, however, the case of second embodiment.

Next, a second embodiment of the invention will be set forth. The difference of the second embodiment from the first one resides in such that scorotron charger 4 is impressed with a.c.-voltage from current source 41' in place of 41 and that a laser optical system is employed as an image exposing apparatus. FIG. 4 corresponds to FIG. 1; FIG. 5 to FIG. 2; and FIG. 6 to FIG. 3, respectively.

More specifically, scorotron charger 4 executes second charging onto the drum surface on which the formation of static latent images have been already performed. The charge wire is connected with a.c.-source 41', while grid 42 is connected with voltage source 43. The charge wire is impressed with alternating voltages from the voltage source 41'. On the other hand, grid 42 is impressed from voltage source 43 with such voltage as being somewhat lower than the surface potential at the non-image areas and having same polarity with charger 2, in the same way with the case of first embodiment. It is necessary that the voltage impressed to grid 42 is higher than the surface potential at image areas of the static latent image, the potential thereat having been lowered considerably under the action of image exposing unit 3.

polarities and voltages of several chargers and the like constituents appearing in the present second embodiment are similar with those which were adopted in the foregoing first embodiment. However, it should be noted that the voltage of the source 41' for scorotron charger 4 is specified to be a.c.-plus/minus 6.0 kV when insulative toner is non-magnetic. With use of magnetic insulative toner, the voltage may be same as above which means a.c.-plus/minus 6.0 kV.

The marginal outline formation process as adopted in the present embodiment will be stepwise set forth hereinbelow:

(i). First charging step:

The surface of sensitive drum 1 is impressed with electrical charge at a predetermined constant level under the action of the charger 2. In the present second embodiment, the drum surface potential is set also to +600 V.

Figure 6:
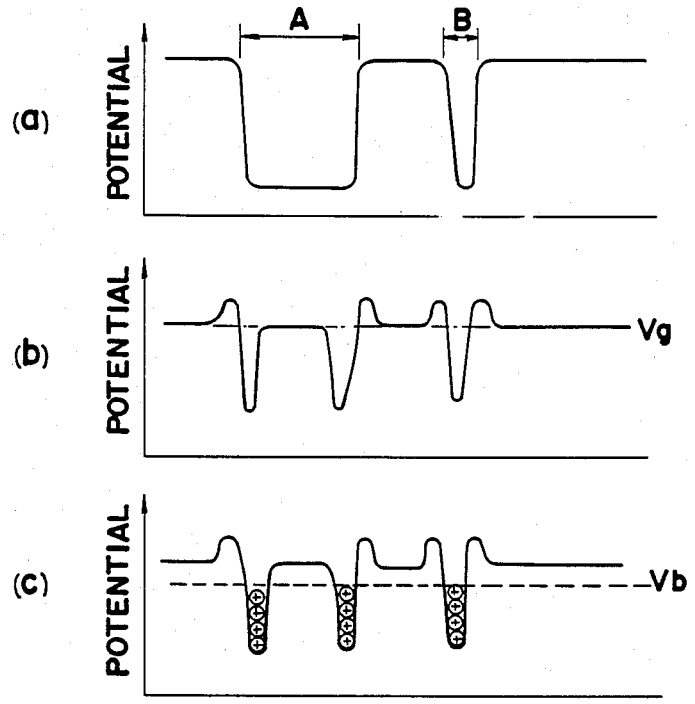
FIG. 6 is a similar view to FIG. 3, showing, however, the case of second embodiment.

(ii). Exposure step:

Then, document's images are exposed and projected onto the thus charged drum surface by reliance of the slit exposure system as conventionally, for providing the corresponding static latent images. As shown in FIG. 6 at (a), the static charge at the imaged areas (A) and (B) is reduced to +100 V or so under the influence of the light projection, while those at non-image areas will remain at +600 V. As the document's images, negative one may be used as same in the foregoing first embodiment.

(iii). Second charging step:

The drum surface formed with static latent images in the foregoing step is subjected to a recharging step with use of scorotron charger 4, impressed with alternating voltages. At this time, grid 42 is charged with a voltage of +500 V from voltage source 43. This voltage impressed to grid 42 is somewhat lower than surface potential, +600 V, at non-image areas of the latent image and enough higher than surface potential, 100 V, at image areas (A) and (B), said voltage being, however, of same polarity with that available in the first charging step.

Between the drum surface 1 and the grid 42, lines of electrical force as schematically shown by arrows (e) in FIG. 5 are present. Negative and positive ions issuing from the charge wire impressed with alternating voltages are subjected to conveying forces along these lines of electric force. In this case, the effective lines of force for accelerating positive ions in proximity of grid 42 towards the drum surface are only those which exist at the central portion of the image area devoid of the inside of the peripheral outline propers of these imaged areas (A) and (B), Therefore, these positive ions, as shown by double-lined arrows (f) in the similar manner as in the foregoing first embodiment, impinge exclusively upon the central portion of the image area devoid of inside peripheral zones of these imaged areas (A) and (B), as an example. As a result, the static potential level at these ion-impinged image areas will be caused to elevate to such a higher level which corresponds substantially to the grid voltage, +500 V.

On the other hand, the negative ions will go ahead, as shown by thickened small arrows (g), towards non-image portions of imaged area devoid of outside peripheral zones of the image areas (A) and (B) for removal of the prevailing electrical charges thereat, thereby the corresponding potential lowering to such a level nearly equal to the grid voltage, +500 V.

When illustrating more specifically in terms of drum surface potentials, the potential at inside band zone along the peripheral outline of a broad areal imaged portion (A) and that residing at an elongated band zone along a strip-like image portion (B), as an example, each having a substantially constant width, remains at a lower potential level of substantially +100 V as shown in FIG. 6 (*b*), while the statically charged non-image area hold their initial surface potential without alteration, amounting substantially to a higher potential level which is substantially +600 V. And the surface potential at non-image areas devoid of the outside peripheral zones of the image areas (A) and (B) will lower to such a level substantially equal to the grid voltage (Vg; +500 V), and further, the central portion of the areal image portion (A) devoid of its inside peripheral zone will elevate in its value to such a level substantially equal to the grid voltage.

More specifically, in case of using non-magnetic insulative toner or magnetic insulative toner, the potential at the central portion of the image areas (A) elevates to about +500 V and the surface potential at the non-image areas lowers to about +500 V by applying the voltage of ±6.0 kV to the scorotron charger 41' as well as the voltage of +500 V to the grid 43.

As a conclusion of the execution of present second charging step, the peripheral outlines of these imaged areas (A) and (B) will be formed in the shape of statically negative latent images, also desirously in the case of present second embodiment.

(iv). Developing step:

The static latent images formed in the foregoing second charging step and in the form of nagative one, will be subjected now to a developing job under the action of developing unit 5.

The developing conditions and mechanism adopted in the present step are substantially similar to those which are adopted in the preceding first embodiment and thus could be omitted from further description without injuring better understanding of the present invention.

As a conclusion, thus it should be noted that the surface potentials prevailing in the non-image areas have been lowered in the second charging step employed in the present invention, and indeed, for the positive prevention of otherwise conventionally possible superfluous and fouling toner deposition.

In this way, the positively charged insulative toner is reliably deposited at lower potential portions of the photo-sensitive drum surface, or more specifically at the marginal outline portions insidely around the central portions of imaged areas (A) and (B), thereby a kind of sharp and clear "inside-embroidering" toner images being effectively produced upon execution of the reverse development job.

It will be clearly understood that according to the inventive principles, lower potential portions of the static latent images formed on the sensitive drum, corresponding to the peripheral outline portions are exclusively deposited with the toner, while other portions consisting of imaged areas, as well as non-image areas are not deposited with the toner, thus providing sharp and clear copied reproduction of marginal outlines of negative document images, and indeed, with amazing success.

In the present invention, reversal development is carried out by the developing unit 5. Therefore, if the second charging step by the scorotron charger 4 is not performed, the negative electrostatic latent image formed at the exposure step may be developed with a general reversal development to obtain a positive image.

The above-mentioned operation can be easily controlled by switching on or off the scorotron charger 4.

Next, the third embodiment of the present invention will be explained hereinbelow.

Figure 7:
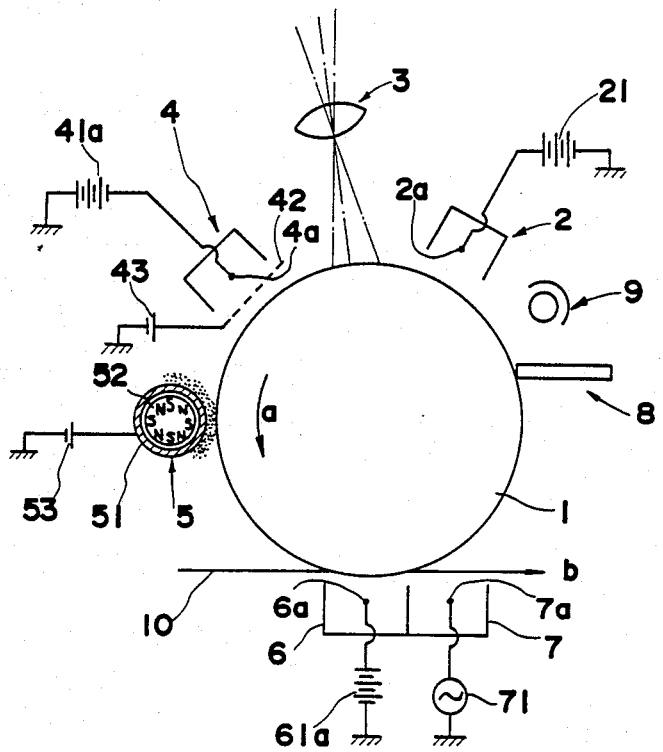
FIG. 7 is a similar view to FIG. 1, showing, however, the case of third embodiment.

An electrophotographic copier employed for the third embodiment and shown in FIG. 7 is almost the same as that shown in FIG. 1. The differences between the copiers shown in FIG. 1 and FIG. 7 are the construction of the scorotron charger 4 and the transfer charger 6.

More specifically, a grid 42 of the second charger 4 is provided which is connected with a separate power source 43, the negative pole thereof being earthed as shown. Charge wire 4*a* is impressed from the power source 41*a* with such a voltage as of reverse polarity with that prevailing at the charger 2. Grid 42 is impressed from power source 43 with an enough lower voltage than the surface potential prevailing at the non-image areas of static latent image on the drum 1, said voltage having some polarity with that prevailing at the charger 2. It should be noted further that the voltage impressed at the grid 42 must be rather higher than the surface potential prevailing at the image areas of the latent image on the drum.

As for the power source 61*a* of the transfer charger 6, the negative pole thereof is earthed as shown.

Structure and arrangement of the other devices are substantially same as that shown in FIG. 1, therefore, the detailed explanation will be omitted here.

In the following, only by way of example, polarities and impressing or impressed voltages with relation to several chargers and the like, as used in the present embodiment, will be set forth.

(IV). In use of non-magnetic insulative toner:
charger (voltage source 21)
positive, +5.5 kV
Scorotron charger (voltage source 41*a*)
negative, −6.0 kV
grid (voltage source 43)
Positive, +200 V.
distance between grid and drum (dg)
1.5 mm
developing bias (voltage source 53)
positive, +300 V.
transfer charger (voltage source 61*a*)
positive, +5.5 kV
insulative toner
negative (V). In use of insulative and magnetic toner:
static charger (voltage source 21)
positive, +5.5 kV
scorotron charger (voltage source 41*a*)
negative, −6.0 kV
grid (voltage source 43)
positive, +200 V
distance between grid and drum (dg)
1.5 mm
developing this (voltage source 53)
positive (d.c.), +170 V
a.c., 350 V rms, 1 kHz,
starting potential for development
250 V
insulative- and magnetic toner
negative It should be noted that above mentioned polarities may be all reversed. Voltage values enlisted above are naturally given only by way of example and thus may be varied according to occasional demands.

The method for the formation of marginal outline image with use of the foregoing copier machine will be set forth stepwise hereinbelow.

(i) First charging step:

This step is identical with that of the first embodiment. In the present third embodiment, the drum surface potential is set also to +600 V.

Figure 9:
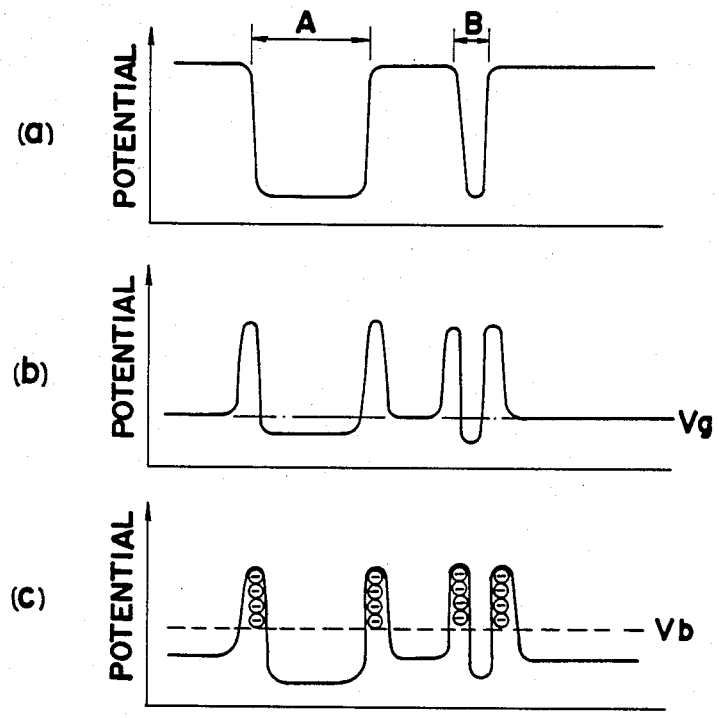
FIG. 9 is a similar view to FIG. 3, showing, however, the case of third embodiment.

(ii) Exposure step:

Original negative document images are exposed onto the drum surface charged with +600 V in the foregoing step. The exposure may be carried into effect by the slit exposure means as conventionally, so as to form the corresponding static latent images thereon. In this case, as shown in FIG. 9 at (a), the charge remaining at image areas (A) and (B) is reduced to +100 V or so, while the charge existing in non-image areas devoid of the imaged one amounts to +600 V-potential. As the document's images, negative one may be used as same in the first embodiment.

(iii). Second charging step:

A charge of opposite polarity with the negative static latent images is applied by the scorotron charger 4 onto the drum surface, on which the negative latent images have been provided to form in the foregoing step. In case that non-magnetic insulative toner or magnetic insulative toner is used, grid 42 is impressed with a voltage of +200 V. The charge at scorotron charger 4 is of the reversed polarity to that adopted in the first charging step, while the voltage as applied to the grid 42 is enough lower than that prevailing at the non-image portion of the static latent images, +600 V, and of the same polarity as was adopted in the first charging step. Additionally, the voltage impressed upon grid 42 is higher than the surface potential, +100 V, at the image portion (A) and (B) of the latent images on the drum.

Figure 8:
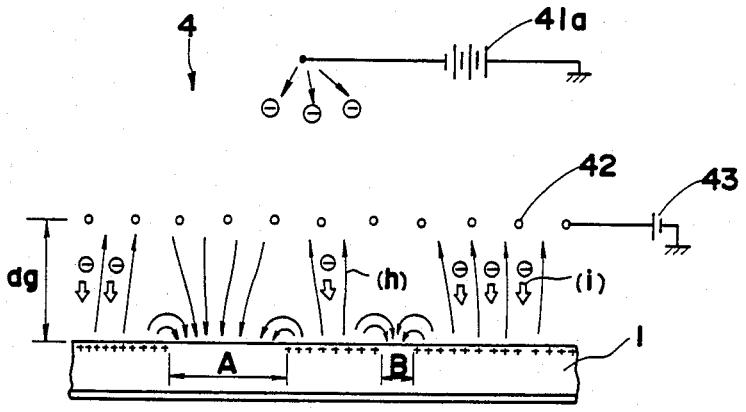
FIG. 8 is a similar view to FIG. 2, showing, however, the case of third embodiment.

As a result, lines of electrical force as shown by arrows (h) in FIG. 8 appearing between the drum surface and the grid are created, and negative ions issuing from the related charge wire will receive conveying forces along the lines of force set forth just above. In this case, the lines of force accelerating the negative ions, in proximity of the grid 42 towards the drum surface at 1, are only effective in the non-image portions devoid of peripheral outlines per se of the image areas (A) and (B). Therefore, the negative ions can arrive exclusively at the non-image portions defined by and devoid of marginal outlines of the imaged areas (A); (B), as shown by double lined small arrows (i). In this way, the potential of the ion-impinged non-image areas will have been lowered nearly to such value as substantially same level as the grid potential, +200 V. In other words, when turning to the corresponding drum surface potential differentials thereby formed, referring to FIG. 9 at (b), the surface potential at the outside of the marginal outline portions of the image areas (A) and (B) will be left at a higher potential level nearly equal to +600 V which corresponds to the initial surface potential. Further, the image areas (A) and (B), each having a substantial constant width, will remain substantially at a constant and low level, +100 V, while the potential at the non-image portion of imaged area (A) and (B) except for the marginal outline portion will be reduced to that equal to the grid voltage (Vg: +200 V) or so. Additionally, the slender, line-like imaged portion (B) is not subjected to surface potential reduction, while the width of the charged zone will be somewhat reduced. In other words, outlines of the imaged areas (A) and (B) are said to have been formed in positive latent images.

(iv). Developing step:

In the present second charging step, the thus foumed positive outline images are further subjected to the presently employed developing step under the action of developing unit 5. When the insulative toner is non-magnetic, the developing sleeve 51 is impressed with a developing bias of +300 V, as an example. This developing bias voltage, Vb, is selected to be somewhat higher than the grid voltage, Vg, +200 V, as an example, and higher than the potential at the non-image area which has been caused to lower to such a value as substantially equal to the grid voltage, Vg, and having the same polarity as was employed in the first charging step, and indeed, for the purpose of preventing superfluous and fouling toner-deposition, not only at non-image areas, but also at imaged areas, surface potentials in the non-image areas having been caused to lower considerably in the second charging step, as was referred to hereinabove.

On the contrary, when the insulative toner is magnetic, the developing sleeve 51 is impressed with a.c.-350 V, 1 kHz, plus d.c.-plus 170 V, as an developing bias.

This developing bias voltage, Vb, is selected to be somewhat lower than the grid voltage, Vg: 200 V, thus being lower than the potential level at the non-image area of the latent image, the latter potential having been lowered precisely or nearly to the grid voltage, Vg. With use of magnetic toner, however, a certain threshold value may exist on account of the very existence of magnetically binding action, the development will normally start at +250 V or so of the surface potential.

Under this operating condition, there is on fear of superfluous and fouling deposition of the toner on the image portions of the statically formed latent image areas as well as the non-image areas, wherein the potential levels at the non-image areas have been caused in the second charging step considerably to lower.

Under these operating conditions, and as shown in FIG. 9 at (c), the negatively charged insulative toner particles will be deposited onto the higher potential regions on the drum surface, or more specifically, exclusively onto a slim outside edge portion of each of the marginal outline portions outsidely around the imaged areas (A) and (B), thereby a kind of tonered "embroidering" outside edge lines being formed upon execution of a regular and normal development job. Then, these toner images are transferred onto the copy paper 10 upon execution of positive discharge at transfer charger 6 and then subjected to a fixing job at a conventional fixing unit, not shown, to provide corresponding photocopied images.

Briefly to say, the reason for said kind of enough lower selection of the grid voltage, Vg, than the surface potential, +600 V, at the non-image areas was such that in the second charging step, surface potential at the non-image areas of the latent image is kept at enough lowered level relative to the said surface potential.

(VI). A slightly modified example from that set forth hereinbefore, and with use of non-magnetic insulative toner which has been used equally in the third embodiment, in such a sense that the operating conditions of the scorotron charger 4 have been changed, will be described. In this case, the following operating items have been modified from those as set forth at the foregoing (IV), although non-magnetic insulative toner has been employed in the foregoing.

scorotron charger (voltage source 41*a*)
negative, −7.0 kV
grid (voltage source 43)
positive, +300 V
distance between grid and drum (dg)
1.00 mm
developing bias (voltage source 53)
positive, +250 V.

In this modification, the charging performance of the scorotron charger 4 is higher than before, the potential part of the non-image areas except for the marginal outline portions of the image portions (A) and (B), will lower to +230 V or so. The developing bias voltage, Vb, has been set to +250 V lower than grid voltage, Vg, or 300 V. On the other hand, it is higher than the said lowered surface potential +230 V, superfluous and fouling deposit of the toner onto the non-image areas can be positively prevented, and so on.

Figure 10:
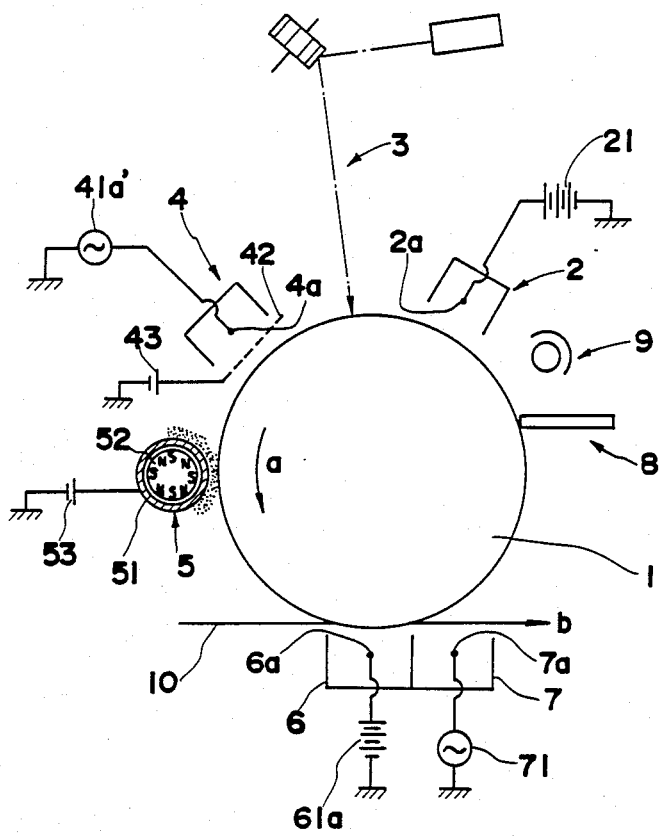
FIG. 10 is a similar view to FIG. 1, showing, however, the case of fourth embodiment.
Figure 11:
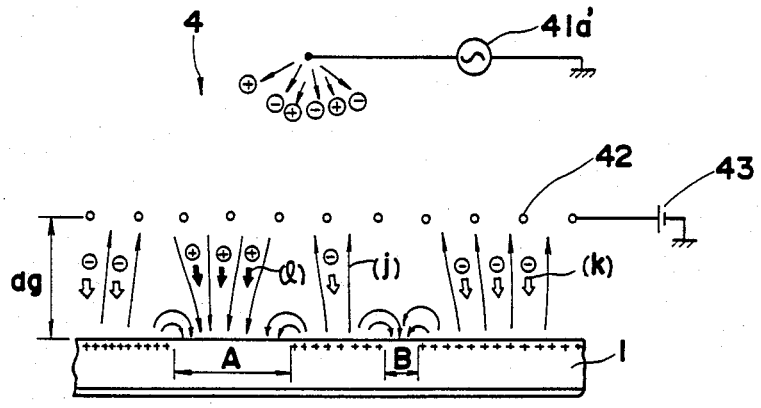
FIG. 11 is a similar view to FIG. 2, showing, however, the case of fourth embodiment.

Next, a fourth embodiment of the invention will be set forth. The difference of the fourth embodiment from the third one resides in such that scorotron charger 4 is impressed with a.c.-voltage from current source 41*a*′ in place of 41. FIG. 10 corresponds to FIG. 7; FIG. 11 to FIG. 8; and FIG. 12 to FIG. 9, respectively.

More specifically, scorotron charger 4 executes second charging onto the drum surface on which the formation of static latent images have been already performed. The charge wire is connected with a.c.-source 41*a*′, while grid 42 is connected with voltage source 43. The charge wire is impressed with alternating voltages from the voltage source 41*a*′. On the other hand, grid 42 is impressed from voltage source 43 with such voltage as being enough lower than the surface potential at the non-image areas and having same polarity with the charger 2, in the same way with the case of third embodiment. It is necessary that the voltage impressed to grid 42 is higher than the surface potential at the static latent image areas, the potential thereat having been lowered considerably under the action of the image exposing unit 3.

Polarities and voltages of several chargers and the like constituents appearing in the present fourth embodiment are similar with those which were adopted in the foregoing third embodiment. However, it should be noted that the voltage of the source 41*a*′ for scorotron charger 4 is specified to be a.c.-plus/minus 6.0 kV when insulative toner is non-magnetic. With use of magnetic insulative toner, the voltage may be same as above which means a.c.-plus/minus 6.0 kV.

The marginal outline formation process as adopted in the present invention will be stepwise set forth hereinbelow.

(i). First charging step:

The surface of sensitive drum 1 is impressed with electrical charge at a predetermined constant level under the action of the charger 2. In the present fourth embodiment, the drum surface potential is set also to +600 V.

Figure 12:
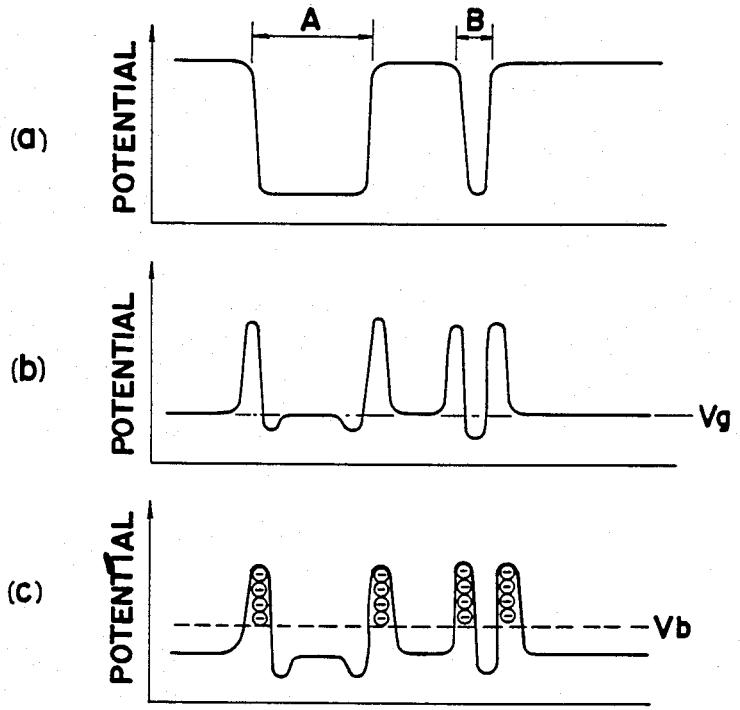
FIG. 12 is a similar view to FIG. 3, showing, however, the case of fourth embodiment.

(ii). Exposure step:

Then, negative document's images are exposed and projected onto the thus charged drum surface by reliance of the slit exposure system as conventionally, for providing the corresponding static latent images. As shown in FIG. 12 at (a), the static charge at the non-image areas remains at +600 V, while those at image areas (A) and (B) will be reduced to +100 V or so under the influence of the laser projection. As the document's images, negative one may be used as same in the foregoing first embodiment.

(iii). Second charging step:

The drum surface formed with negative static latent images in the foregoing step is subjected to a recharging step with use of scorotron charger 4, impressed with alternating voltages. At this time, grid 42 is charged with a voltage of +200 V from voltage source 43. This voltage impressed to grid 42 is enough lower than surface potential, +600 V, at the non-image areas and higher than surface potential, 100 V, at the image areas (A) abd (B), said voltage being, however, of same polarity with that available in the first charging step.

Between the drum surface 1 and the grid 43, lines of electrical force as schematically shown by arrows (j) in FIG. 11 are present. Negative and positive ions issuing from the charge wire impressed with alternating voltages are subjected to conveying forces along these lines of electric force. In this case, the effective lines of force for accelerating negative ions in proximity of grid 42 towards the drum surface are only those which exist at non-image areas devoid of and at inside of the peripheral outline portions of these imaged areas (A) and (B). Therefore, these negative ions, as shown by double-lined arrows (k) in the similar manner as in the foregoing third embodiment, impinge exclusively upon the non-image areas devoid of outside peripheral zones of the imaged areas (A) and (B), as an example. As a result, the potential level at these ion-impinged imaged areas will be caused to lower to such a lower level which corresponds substantially to the grid voltage, +200 V.

On the other hand, the positive ions will go ahead, as shown by thickened small arrows (l), towards the central portion of the image area (A) exclusive of the outline portion of imaged area (A) for elevating the prevailing electrical charges thereat, thereby the corresponding potential elevating to such a level nearly equal to the grid voltage, +200 V.

When illustrating more specifically in terms of drum surface potentials, the potential at outside band zone along the peripheral outline of image areas (A) and (B), each having a substantially constant width, hold their initial surface potential without alteration, amounting substantially to a higher potential level which is substantially +600 V, while the potential at inside band zone along the peripheral outline of a broad areal imaged portion (A) and that residing at a strip-like image portion (B) remain at a lwoer potential level of substantially +100 V as shown in FIG. 12(*b*).

And the surface potential at the central portion of the image area (A) exclusive of the inside marginal outline portion will elevate in its value to such a level substantially equal to the grid voltage (Vg; +200 V), and further, the surface potential at the non-image areas devoid of the outside marginal outline portion of the image areas (A) and (B) will lower to such a level substantially equal to the grid voltage.

More specifically, in case of using non-magnetic insulative toner or magnetic insulative toner, the potential at the non-image areas lowers to about +200 V and the surface potential at the central portion of the image areas elevates to about +200 V by applying the voltage of ±6.0 kV to the scorotron charger 41*a*′ as well as the voltage of +200 V to the grid 43.

As a conclusion of the execution of present fourth charging step, the peripheral outlines of these imaged areas (A) and (B) will be formed in the shape of statically positive latent images, also desirously in the case of present fourth embodiment.

(iv). Developing step:

The static latent images fomred in the foregoing second charging step and in the form of positive one, will be subjected now to a developing job under the action of developing unit 5.

The developing conditions and mechanism adopted in the present step are substantially similar to those which were adopted in the preceding third embodiment and thus could be omitted from further description without injuring better understanding of the present invention.

As a conclusion, thus is should be noted that the surface potentials, prevailing in the central portion of the latent-imaged areas, have been elevated to such a value nearly equal to the grid voltage Vg in the second charging step employed in the present invention, and indeed, for the positive prevention of otherwise conventionally possible superfluous and fouling toner deposition.

In this way, the negatively charged insulative toner is reliably deposited at higher potential portions of the photo-sensitive drum surface, or more specifically at the marginal outline portions outsidely around the substantive portions of imaged areas (A) and (B), therby a kind of sharp and clear "outside-embroidering" toner images being effectively produced upon execution of the regular and normal development job.

It will be clearly understood that according to the inventive principles, higher potential portions of the static latent images formed on the sensitive drum, corresponding to the outsidely peripheral outline portions are exclusively deposited with the toner, while other portions consisting of imaged areas, as well as non-image areas are not deposited with the toner, thus providing sharp and clear copied reproduction of outsidely marginal outlines of negative document images with amazing success.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A method for forming an outline of an image wherein the outline of an image is visualized to form, said method comprising:

a first step of charging an electrostatic latent image bearing member to a pedetermined surface potential;

a second step of irradiating the charged electrostatic latent image bearing member to a negative image to thereby form a negative electrostatic latent image;

a third step or re-charging the irradiated electrostatic latent image bearing member with a scorotron charger while applying the voltage of the polarity same as the polarity of the first step of charging to a grid, said voltage to the grid being slightly lower than the surface potential of a non-image portion of the electrostatic latent image formed by the second step; and a fourth step of developing the electrostatic latent image formed through the third step with a reversal development by using a toner charged to a polarity same as the polarity of the first step.

2. A method for forming an outline of an image wherein the outline of an image is visualized fo form, said method comprising:

a first step of charging an electrostatic latent image bearing member to a predetermined surface potential of a specific polarity;

a second step of irraidating the charged electrostatic latent image bearing member to a negative image to thereby form a negative electrostatic latent image;

a third step of re-charging the electrostatic latent image bearing member irradiated by the second step with a scorotron charger while applying a voltage to a grid to thereby raise the potential of an image portion of the latent image exclusive of an outline portion of the image to a potential approximately equal to the voltage of said grid, the voltage applied to the grid being slightly lower than the surface potential of a non-image portion of the latent image, being sufficiently higher than the potential of the image portion of the latent image and being of the same polarity as the polarity of the first step; and a fourth step of developing the electrostatic latent image formed through the third step with a reversal development by using a toner charged to a polarity same as the polarity of the first step.

3. A method for forming an outline of an image as claimed in claim 2 wherein said scorotron charger is applied with a voltage of a polarity same as the polarity of the first step.

4. A method for forming an outline of an image as claimed in claim 2 wherein said scorotron charger is applied with an alternating current voltage.

5. A method for forming an outline of an image as claimed in claim 2 wherein a developing bias is applied, at the fourth step, with a voltage of a polarity same as the polarity of the first step.

6. A method for forming an outline of an image wherein an outline of a negative image is visualized to form, said method comprising:

a first step of charging an electrostatic latent image bearing member to a predetermined surface potential of a specific porality;

a second step of irradiating the charged electrostatic latent image bearing member to a negative image to thereby form a negative electrostatic latent image;

a third step of re-charging the electrostatic latent image bearing member irradiated by the second step with a scorotron charger while applying a voltage to a grid to thereby raise the potential of an image portion of the latent image exclusive of an outline portion to a potential approximately equal to the voltage of said grid, the voltage applied to the grid being slightly lower than the surface potential of a non-image portion of the latent image, being sufficiently higher than the potential of the image portion of the latent image and being of the same polarity as the polarity of the first step; and a fourth step of developing the electrostatic latent image formed through the third step with a reversal development by using a non-magnetic toner while applying a voltage to a developing bias, said voltage being slightly lower than the voltage of the grid and being the same polarity as the polarity of the first step.

7. A method for forming an outline of an image as claimed in claim 6 wherein said scorotron charger is applied with a voltage of a polarity same as the polarity of the first step.

8. A method for forming an outline of an image as claimed in claim 6 wherein said scorotron charger is applied with an alternating current voltage for lowering the potential of the non-image portion of the latent image exclusive of an outline portion of the latent image to a potential approximately equal to the voltage of said grid.

9. A method for forming an outline of an image wherein the outline of an image is visualized to form, said method comprising:

a first step of charging an electrostatic latent image bearing member to a predetermined potential of a specific porality;

a second step of irradiating the charged electrostatic latent image bearing member to a negative image to thereby form a negative electrostatic latent image;

a third step of re-charging the irradiated electrostatic latent image bearing member with a scorotron charger to raise the potential of an image portion of said latent image exclusive of an outline portion to a potential slightly lower than the potential of the surface potential of a non-image portion of the latent image so that the outline portion has a lower potential than the other portion; and a fourth step of developing the electrostatic latent image formed through the third step with a reversal development by using a toner charged to a polarity same as the polarity of the first step in order to visualize only the outline portion with a lower potential.

10. A method for forming an outline of an image wherein the outline of an image is visualized to form, said method comprising:

a first step of charging an electrostatic latent image bearing member to a predetermined surface potential;

a second step of irradiating the charged electrostatic latent image bearing member to a negative image to thereby form a negative electrostatic latent image;

a third step of charging the irradiated electrostatic latent image bearing member with a scorotron charger while applying the voltage of the polarity same as the polarity of the first step of charging to a grid, said voltage to a grid being sufficiently lower than the surface potential of a non-image portion of the electrostatic latent image formed by the second step; and a fourth step of developing the electrostatic latent image formed thriough the third step with a normal development by using a toner charged to a polarity opposite to the first step of charging.

11. A method for forming an outline of an image wherein an outline of an image is visualized to form, said method comprising:

a first step of charging an electrostatic latent image bearing member to a predetermined surface potential of a specific polarity;

a second step of irradiating the charged electrostatic latent image bearing member to a negative image to thereby form a negative electrostatic latent image;

a third step of re-charging the electrostatic latent image bearing member irradiated by the second step with a scorotron charger while applying a volage to a grid to thereby lower the potential of a non-image portion exclusive of an outline portion of the electrostatic latent image to a potential approximately equal to the voltage of said grid, the voltage applied to the grid being sufficiently lower than the surface potential of the non-image portion of the latent image, being slightly higher than that of an image portion of said latent image and being of the same polarity ad the polarity of the first step; and a fourth step of developing the electrostatic latent image formed through the third step with a normal development by using a toner charged to a polarity opposite to the polarity of the first step.

12. A method for forming an outline of an image as claimed in claim 11 wherein said scorotron charger is applied with a voltage of a polarity opposite to the polarity of the first step.

13. A method for forming an outline of an image as claimed in claim 11 wherein said scorotron charger is applied with an alternating current voltage for rising the potential at the non-image areas of the electrostatic latent image to a potential approximately equal to the voltage of said grid.

14. A method for forming an outline of an image as claimed in claim 11 wherein a developing bias is applied, at the fourth step, with a voltage of a polarity same as the polarity of the first step.

15. A method for forming an outline of an image wherein an outline of a negative image is visualized to form, said method comprising:

a first step of charging an electrostatic latent image bearing member to a predetermined surface potential of a specific polarity;

a second step of irradiating the charged electrostatic latent image bearing member to a negative image to thereby form a negative electrostatic latent image;

a third step of re-charging the electrostatic latent image bearing member irradiated by the second step with a scorotron charger while applying a voltage to a grid to thereby lower the potential of a non-image portion exclusive of an outline portion of the electrostatic latent image to a potential approximately equal to the voltage of said grid, the voltage applied to the grid being sufficiently lower than the surface potential of the non-image portion of the latent image, being slightly higher than that of an image portion of said latent image and being of the same polarity as the polarity of the first step; and a fourth step of developing the electrostatic latent image formed through the third step with a normal development by using a non-magentic toner while applying a voltage to a developing bias, said voltage being slightly higher than the voltage of the grid and being the same polarity as the polarity of the first step.

16. A method for forming an outline of an image as claimed in claim 15 wherein said scorotron charger is applied with a voltage of a polarity opposite to the polarity of the first step.

17. A method for forming an outline of an image as claimed in claim 15 wherein said scorotron charger is applied with an alternating current voltage for rising the potential of the image portion of the electrostatic latent image to a potential approximately equal to the voltage of said grid.

18. A method for forming an outline of an image wherein the outline of an image is visualized to form, said method comprising:

a first step of charging an electrostatic latent image bearing member to a predetermined potential of a specific polarity;

a second step of irradiating the charged electrostatic latent image bearing member to a negative image to thereby form a negative electrostatic latent image;

a third step of re-charging the irradiated electrostatic latent image bearing member with a scorotron charger to lower the potential of a non-image portion of said latent image exclusive of an outline portion of said electrostatic latent image to a potential slightly higher than the potential of an image portion of said latent image so that the outline portion has a higher potential than the other portion; and a fourth step of developing the electrostatic latent image formed through the third step with a normal development by using a toner charged to a polarity opposite to the polarity of the first step in order to visualize only the outline portion of the latent image.

* * * * *